US007481313B1

(12) United States Patent
Kramedjian et al.

(10) Patent No.: US 7,481,313 B1
(45) Date of Patent: Jan. 27, 2009

(54) CANDY DISPLAY SYSTEM

(75) Inventors: Armand Kramedjian, Atlanta, GA (US); Robert A. Davis, Roswell, GA (US)

(73) Assignee: The Hammer Corporation, Atlanta, GA (US)

( * ) Notice: Subject to any disclaimer, the term of this patent is extended or adjusted under 35 U.S.C. 154(b) by 516 days.

(21) Appl. No.: 11/235,445

(22) Filed: Sep. 26, 2005

(51) Int. Cl.
*B65D 75/00* (2006.01)

(52) U.S. Cl. ..... 206/427; 206/805; 206/817; 221/279; 211/72; 211/126.15

(58) Field of Classification Search ..... 206/427, 206/556, 805, 817; 221/279; 211/72, 74, 211/85, 126.2, 130.1, 126.15, 132.1, 195; 220/534, 536; 229/120.33
See application file for complete search history.

(56) References Cited

U.S. PATENT DOCUMENTS

| | | | | |
|---|---|---|---|---|
| 1,541,173 | A * | 6/1925 | Ormond | 220/536 |
| 5,012,936 | A * | 5/1991 | Crum | 211/59.3 |
| 5,197,631 | A * | 3/1993 | Mishima | 221/52 |
| 5,791,555 | A | 8/1998 | Kanter | 229/164 |
| 5,957,294 | A | 9/1999 | Kanter | 206/774 |
| 6,189,780 | B1 | 2/2001 | Kanter | 229/242 |
| 6,378,702 | B1 * | 4/2002 | Kintzig | 206/456 |
| 6,435,403 | B1 | 8/2002 | Giblin et al. | 229/164 |
| 6,454,107 | B1 * | 9/2002 | Belanger et al. | 211/59.3 |
| 6,932,265 | B2 | 8/2005 | Sax et al. | 229/122 |
| 2003/0004044 | A1 | 1/2003 | Kelley | 493/51 |

* cited by examiner

*Primary Examiner*—David T Fidei
(74) *Attorney, Agent, or Firm*—Nelson Mullins Riley & Scarborough, LLP

(57) ABSTRACT

A display apparatus for displaying and dispensing a plurality of items, the apparatus including a box having a front wall, a back wall, a first side wall, a second side wall, and a bottom wall. A dispensing mechanism is slidably disposed within the box and moveable along a longitudinal axis between the box front wall and the box back wall. A biasing device has a first portion secured adjacent the box front wall and a second portion secured adjacent the dispensing mechanism such that the biasing device biases the dispensing mechanism toward the box front wall as the items are removed from between the dispensing mechanism and the box front wall.

17 Claims, 18 Drawing Sheets

CANDY DISPLAY SYSTEM

This application claims priority to U.S. Provisional Application No. 60/613,976, filed Sep. 28, 2004, the entire disclosure of which is incorporated by reference herein.

FIELD OF THE INVENTION

The present invention relates generally to display systems, and more particularly, to a self feeding display apparatus.

SUMMARY OF THE INVENTION

One embodiment of the invention includes a display apparatus for displaying and dispensing a plurality of items disposed therein. The display apparatus includes a box having a front wall, a back wall, a first side wall, a second side wall, and a bottom wall. A dispensing mechanism is slidably disposed within the box and moveable along a longitudinal axis between the box front wall and the box back wall. A biasing device has a first portion secured adjacent the box front wall and a second portion secured adjacent the dispensing mechanism such that the biasing device biases the dispensing mechanism toward the box front wall as the items are removed from between the dispensing mechanism and the box front wall.

Another embodiment of the invention includes a display apparatus for displaying a plurality of items, the apparatus including a box having a front wall, a back wall, a bottom wall, a first side wall including a first reinforcing member foldably attached thereto, and a second side wall including a second reinforcing member foldably attached thereto. A U-shaped bracket having a first side wall, a second side wall, and a front wall extending therebetween, is disposed in the box such that the bracket first side wall is disposed between the box first side wall and the first reinforcing member, the bracket second side wall is disposed between the box second side wall and the second reinforcing member, and the bracket front wall is adjacent the box front wall. A dispensing mechanism is slidably disposed within the box, the dispensing mechanism having a first side wall disposed adjacent the box first side wall, a second side wall disposed adjacent the box second side wall, and a front wall extending between the first and the second side walls of the dispensing mechanism. A biasing device is secured to the box and the dispensing mechanism such that the dispensing mechanism is biased toward the box front wall.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
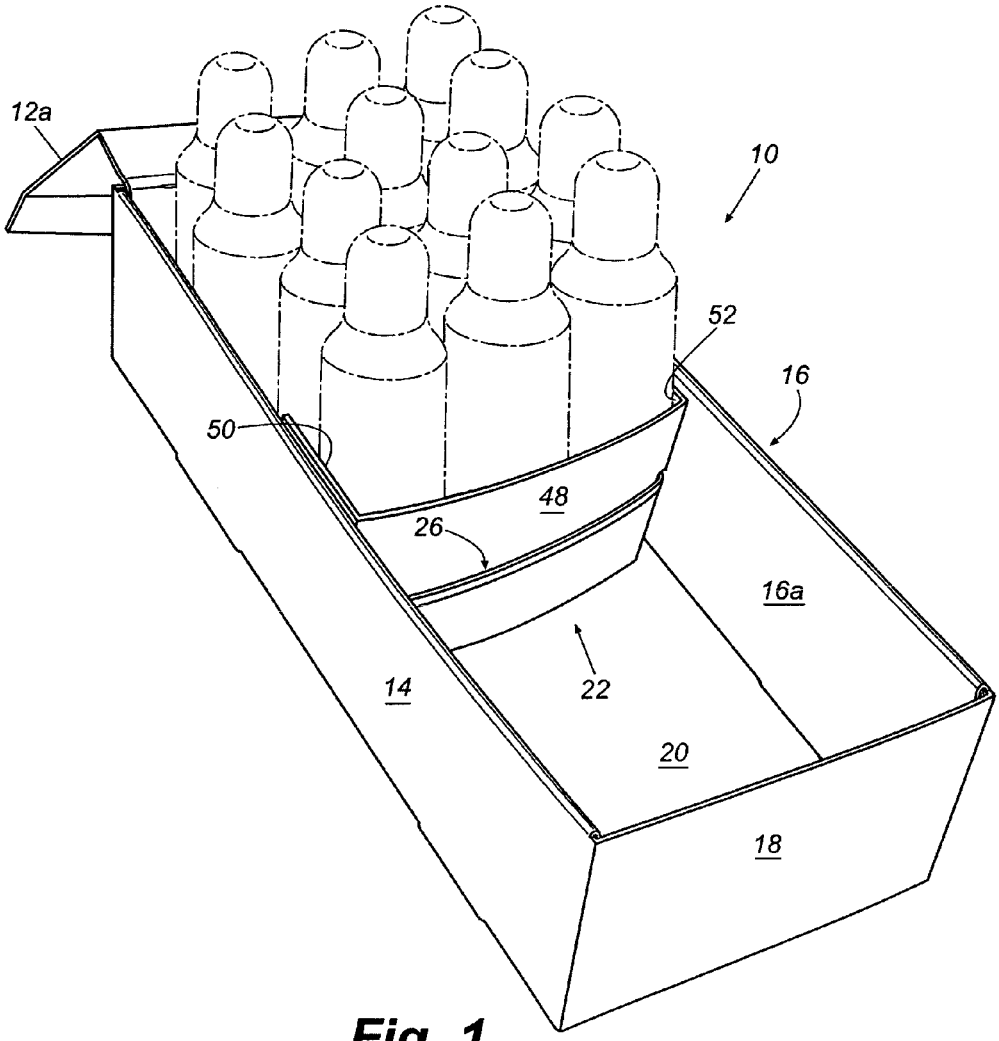
FIG. 1 is a perspective view of a display apparatus in accordance with an embodiment of the present invention.
Figure 2:
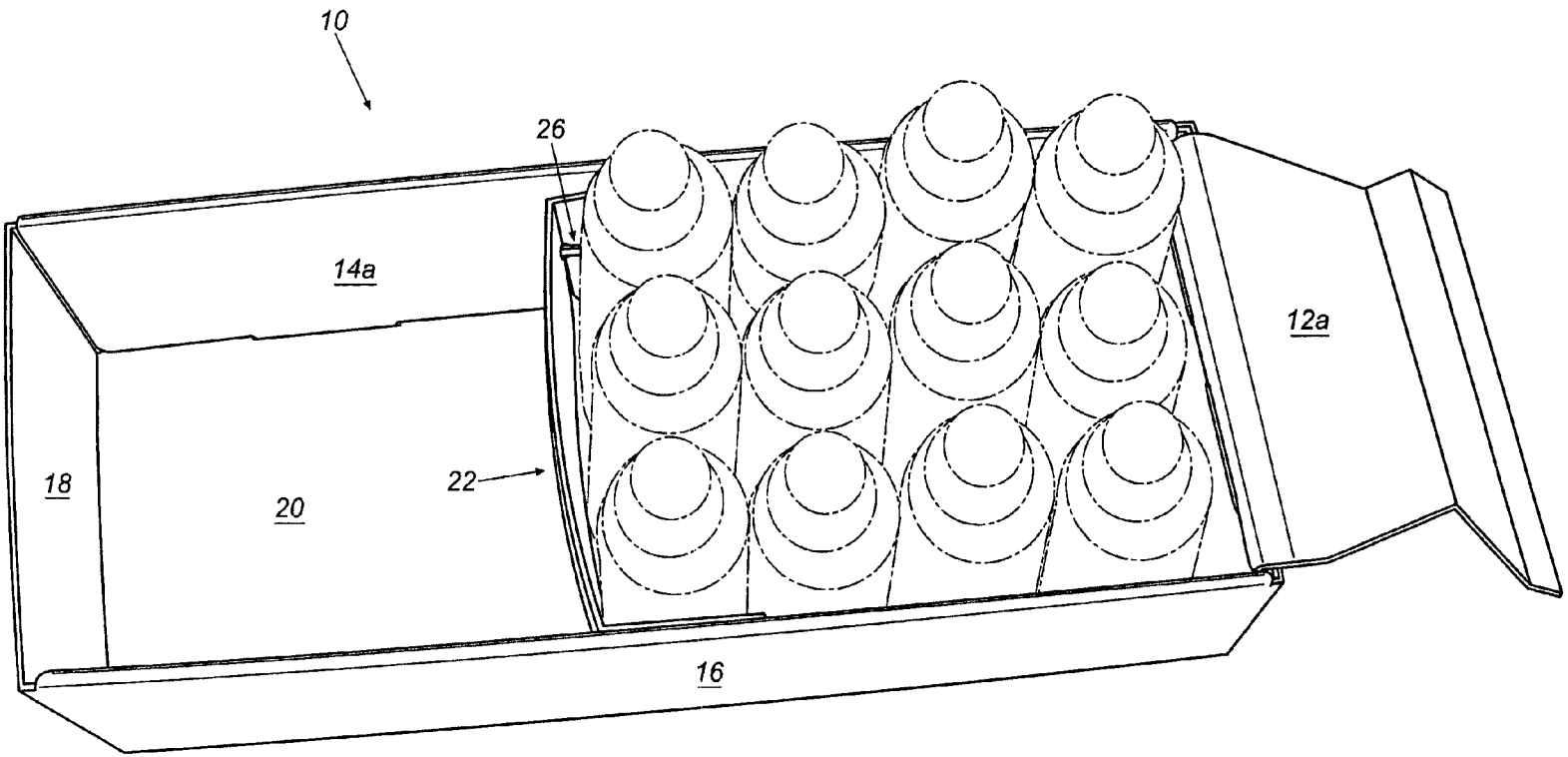
FIG. 2 is a top view of the display apparatus of FIG. 1 shown holding multiple displayed products.
Figure 3:
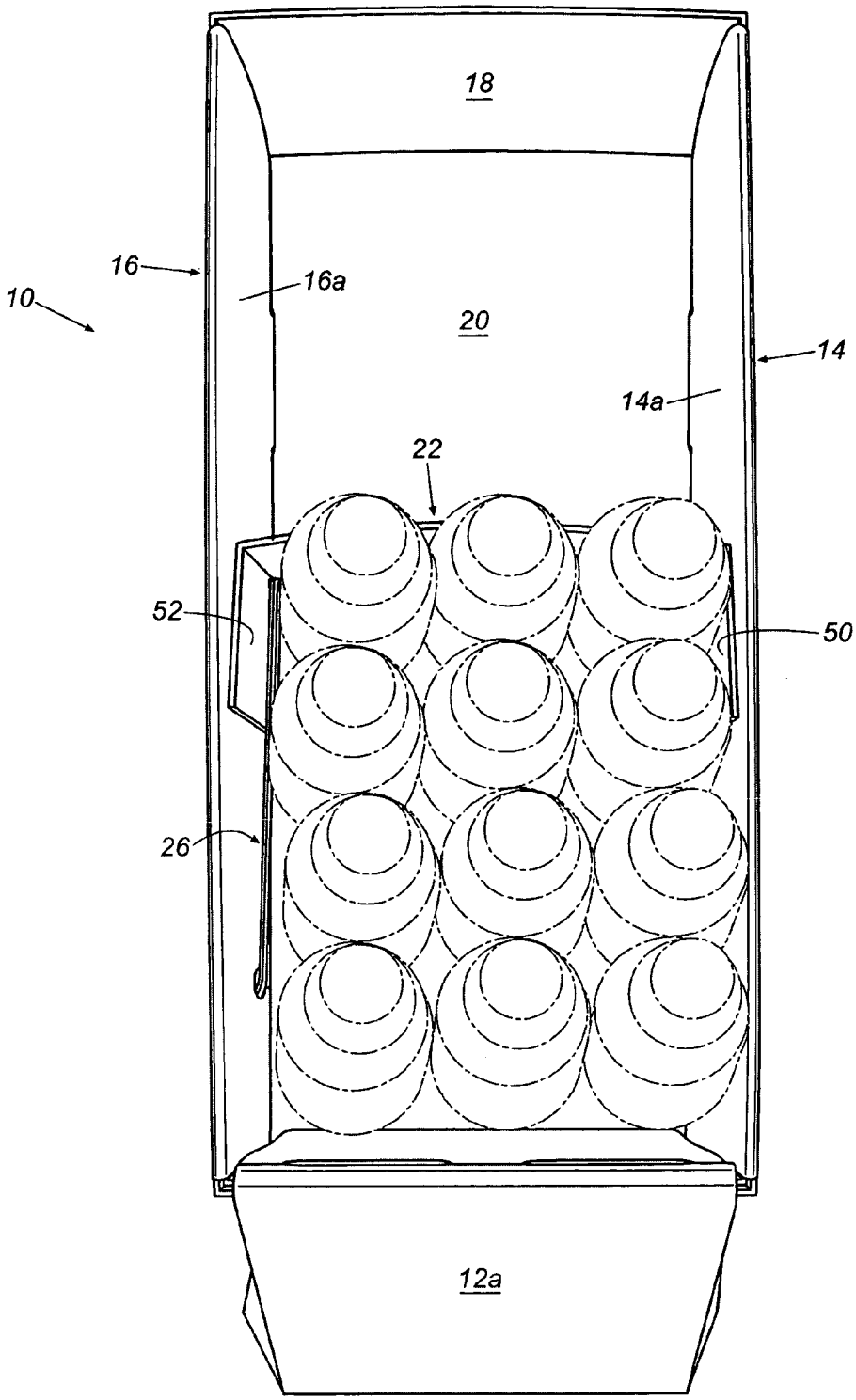
FIG. 3 is a top view of the display apparatus of FIG. 1 shown holding multiple displayed products.
Figure 4:
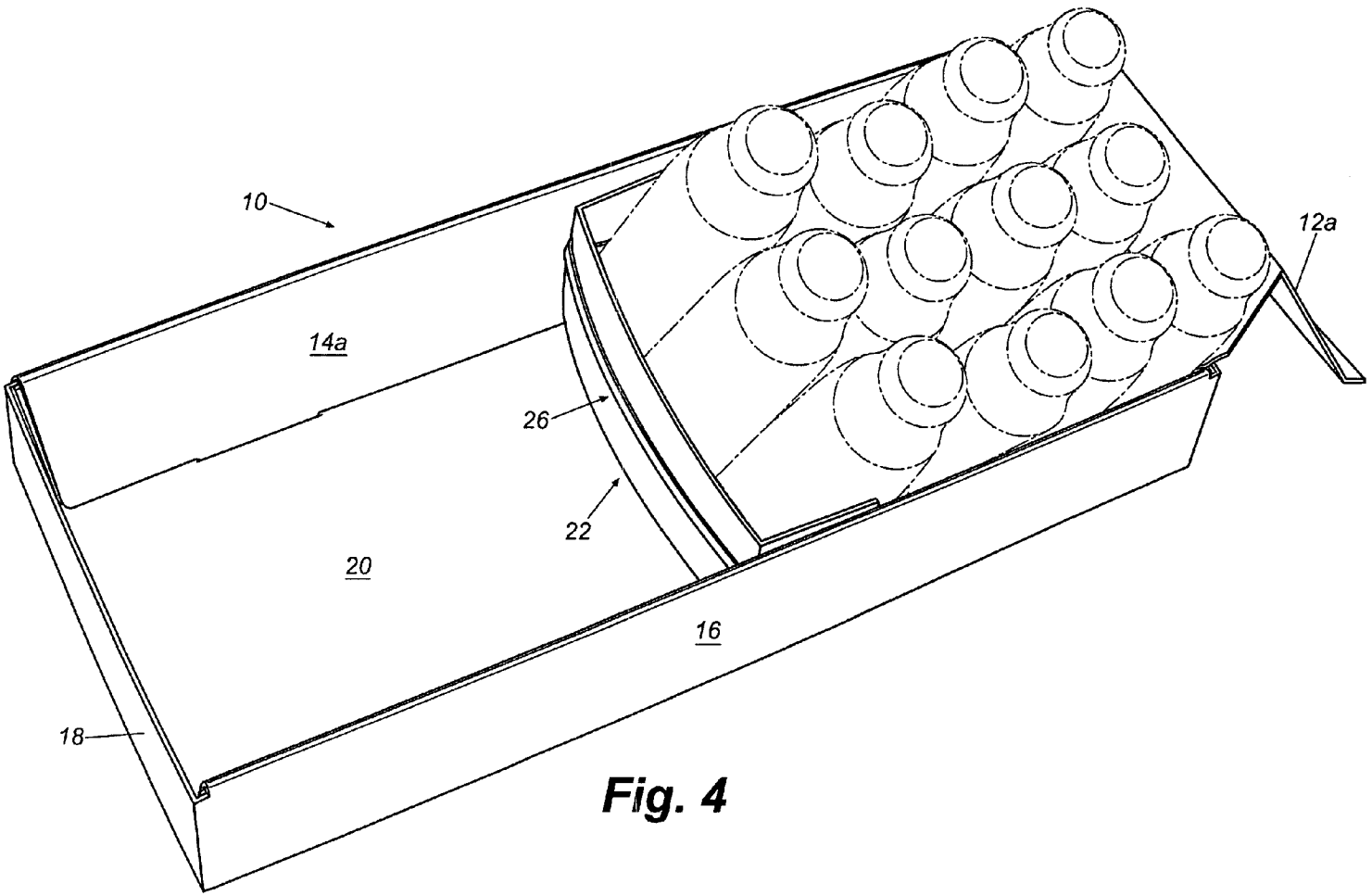
FIGS. 4 and 5 are perspective views of the display apparatus of FIG. 1.
Figure 5:
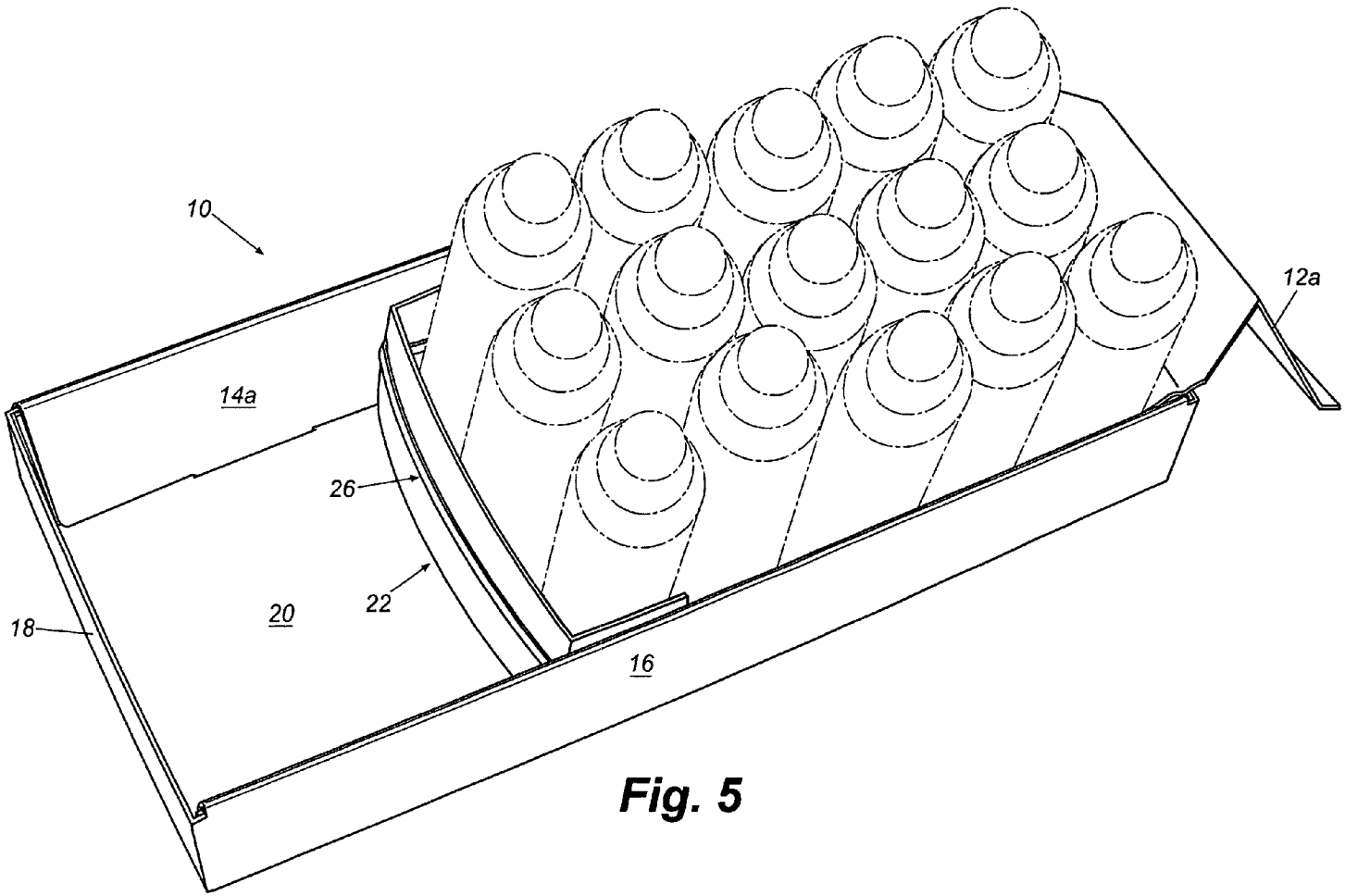
Figure 6:
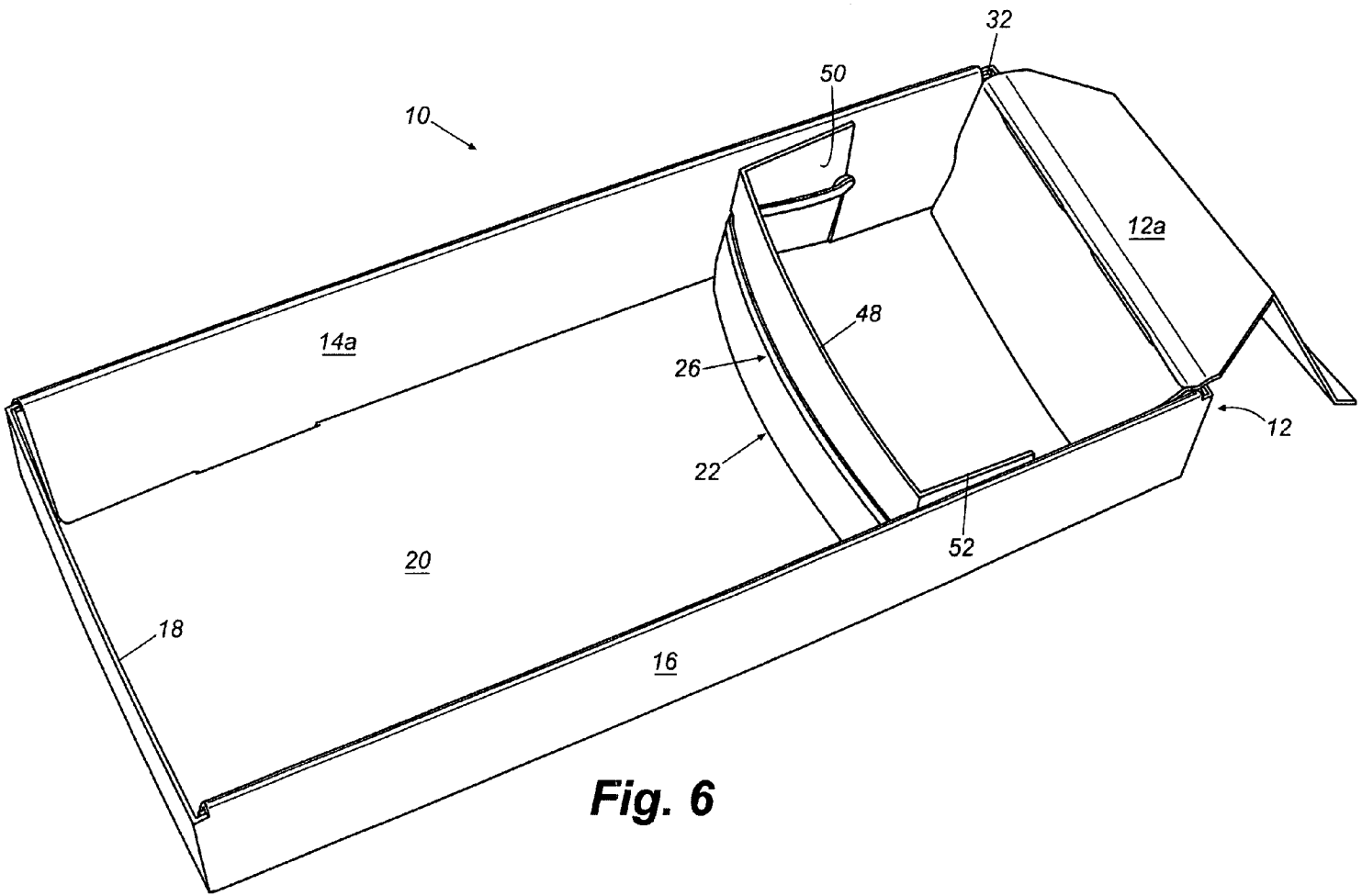
FIGS. 6 and 7 are perspective views of the display apparatus of FIG. 1 shown empty.
Figure 7:
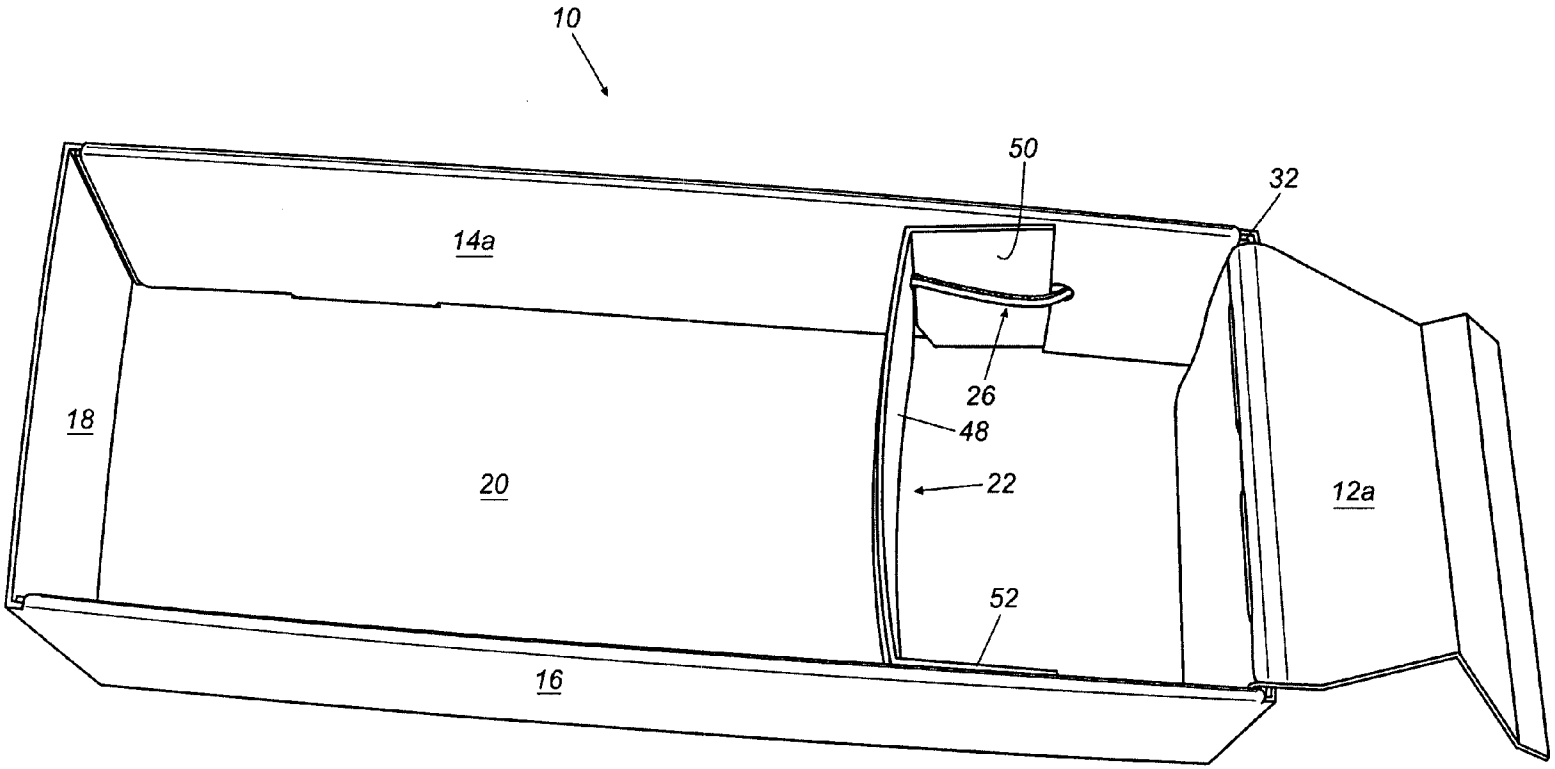

Repeat use of reference characters in the present specification and drawings is intended to represent same or analogous features or elements of the invention.

DETAILED DESCRIPTION

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIGS. 1-11, a display apparatus 10 is shown having a front wall 12, side walls 14 and 16, a back wall 18 and a bottom wall 20. Together the front, side, back and bottom walls form a rectangular display having an opened top. It should be understood that the shape of the display apparatus may also be square or take on various other shapes. A biased dispensing mechanism 22 is slidably received in display apparatus 10 and is biased toward front wall 12. In one preferred embodiment, biased dispensing mechanism 22 has a U-shaped wall that is axially biased forward by a rubber band 26.

Figure 8:
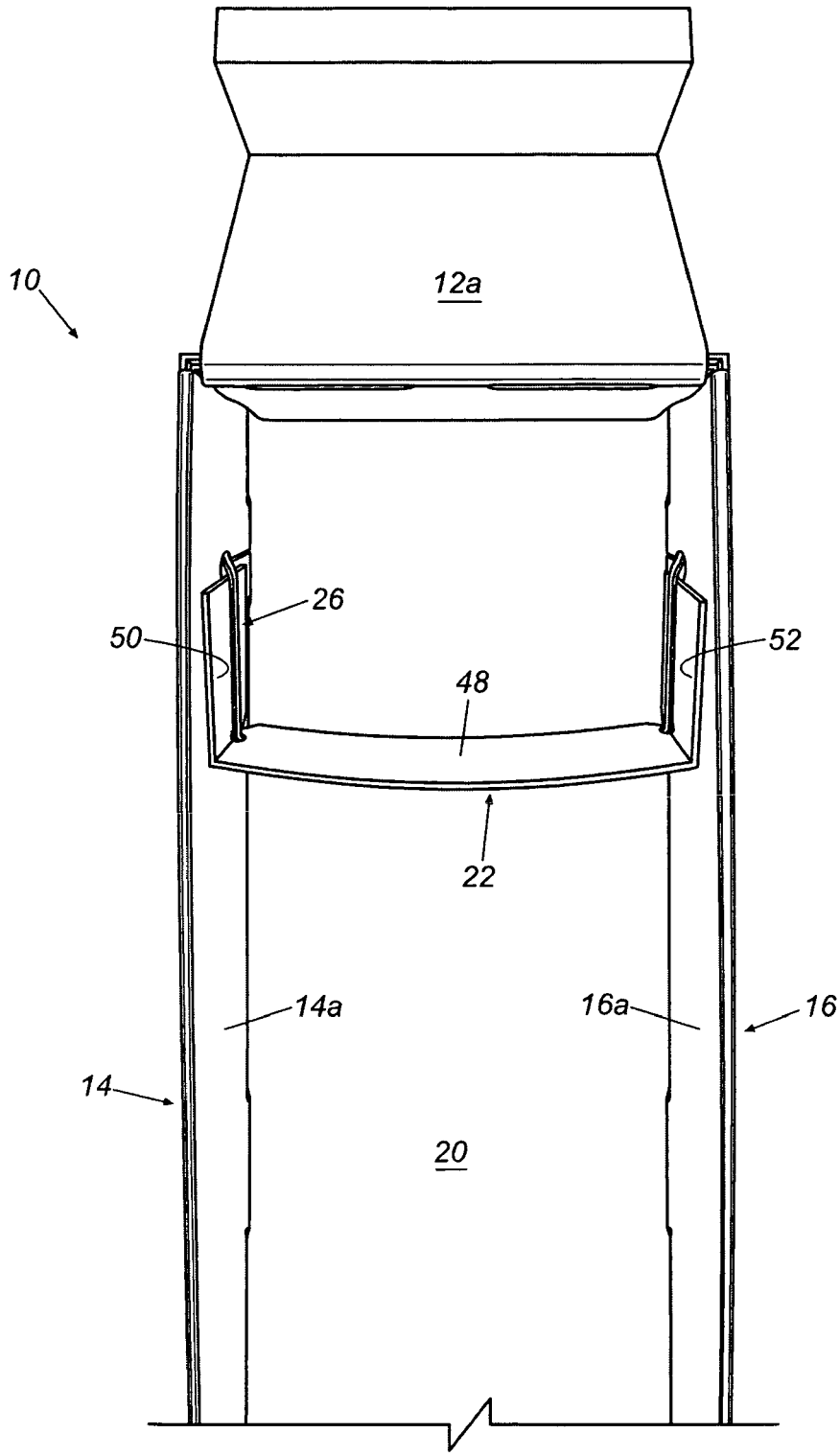
FIG. 8 is a top view of the display apparatus of FIG. 1 shown empty.
Figure 9:
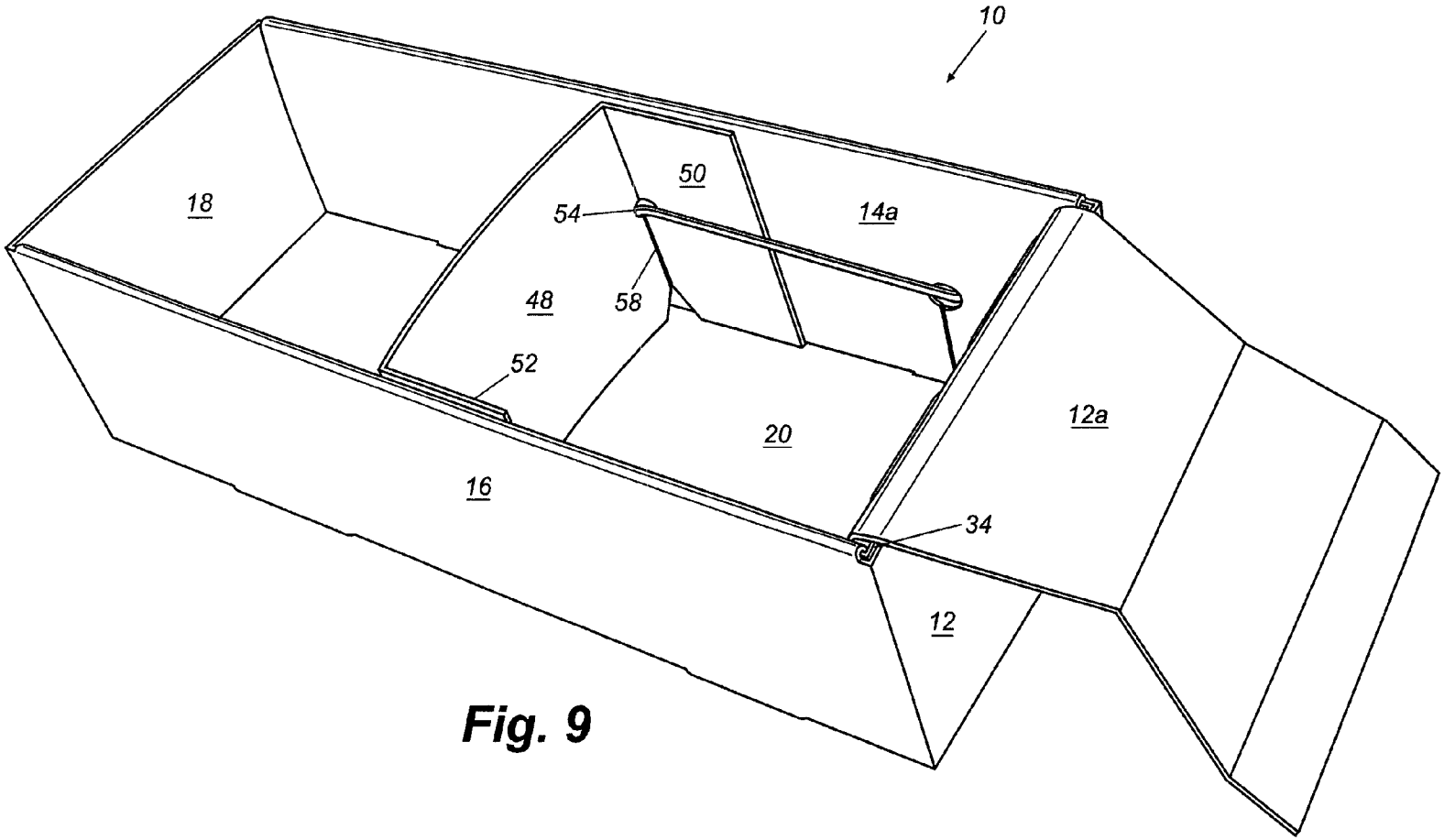
FIG. 9 is a perspective view of the display apparatus of FIG. 1.
Figure 10:
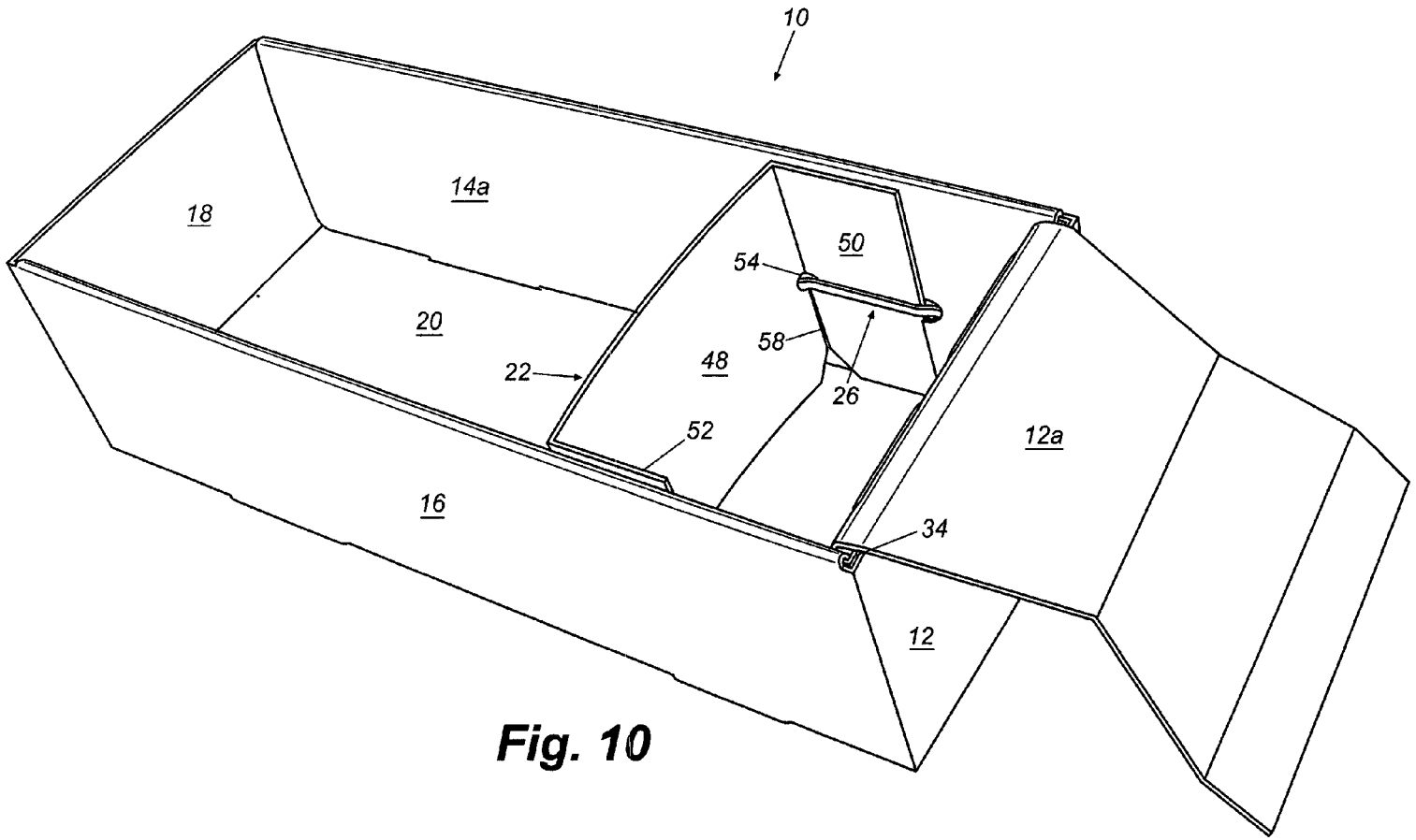
FIGS. 10 and 11 are perspective views of the display apparatus of FIG. 1.
Figure 11:
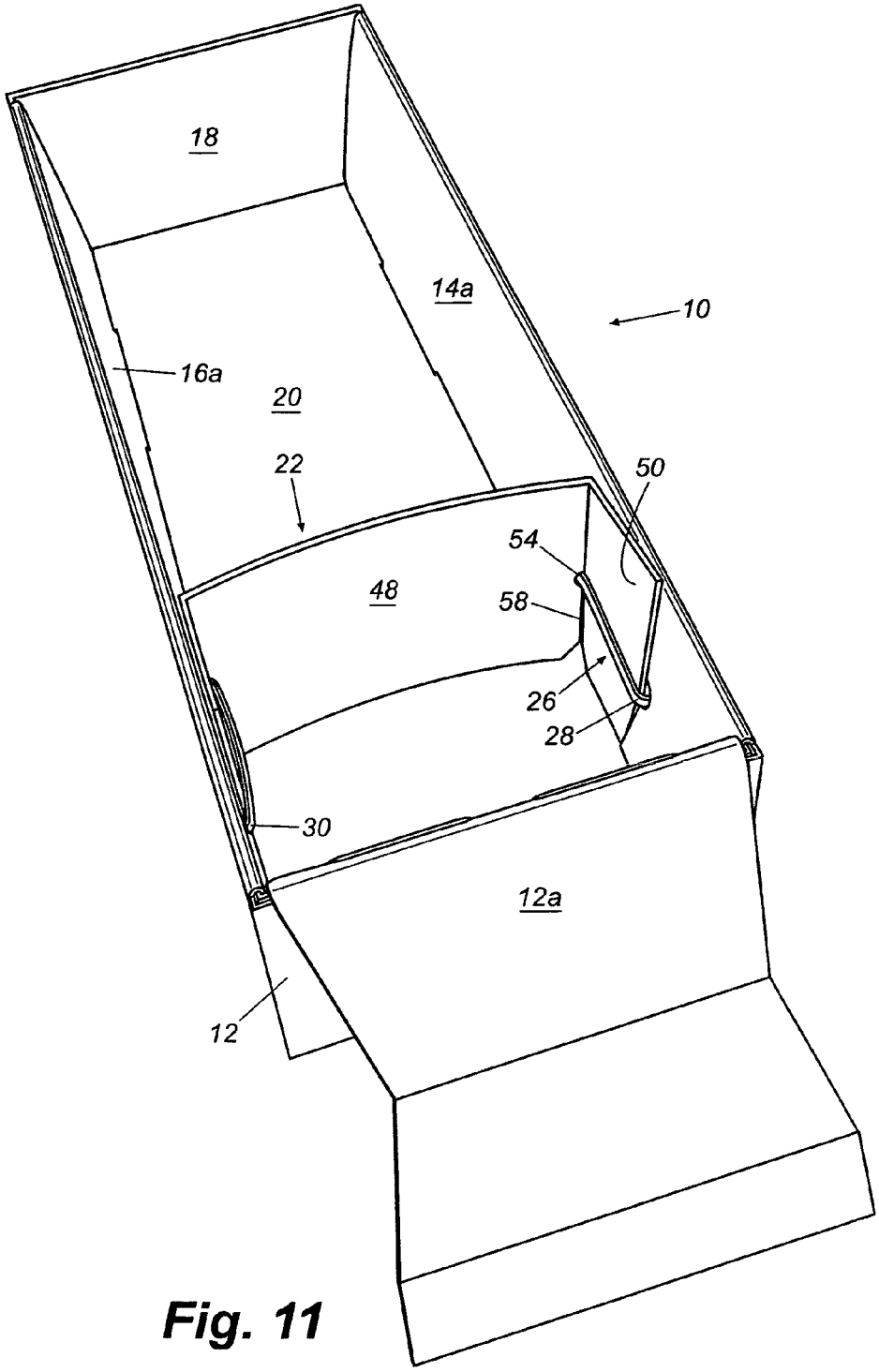
Figure 12:
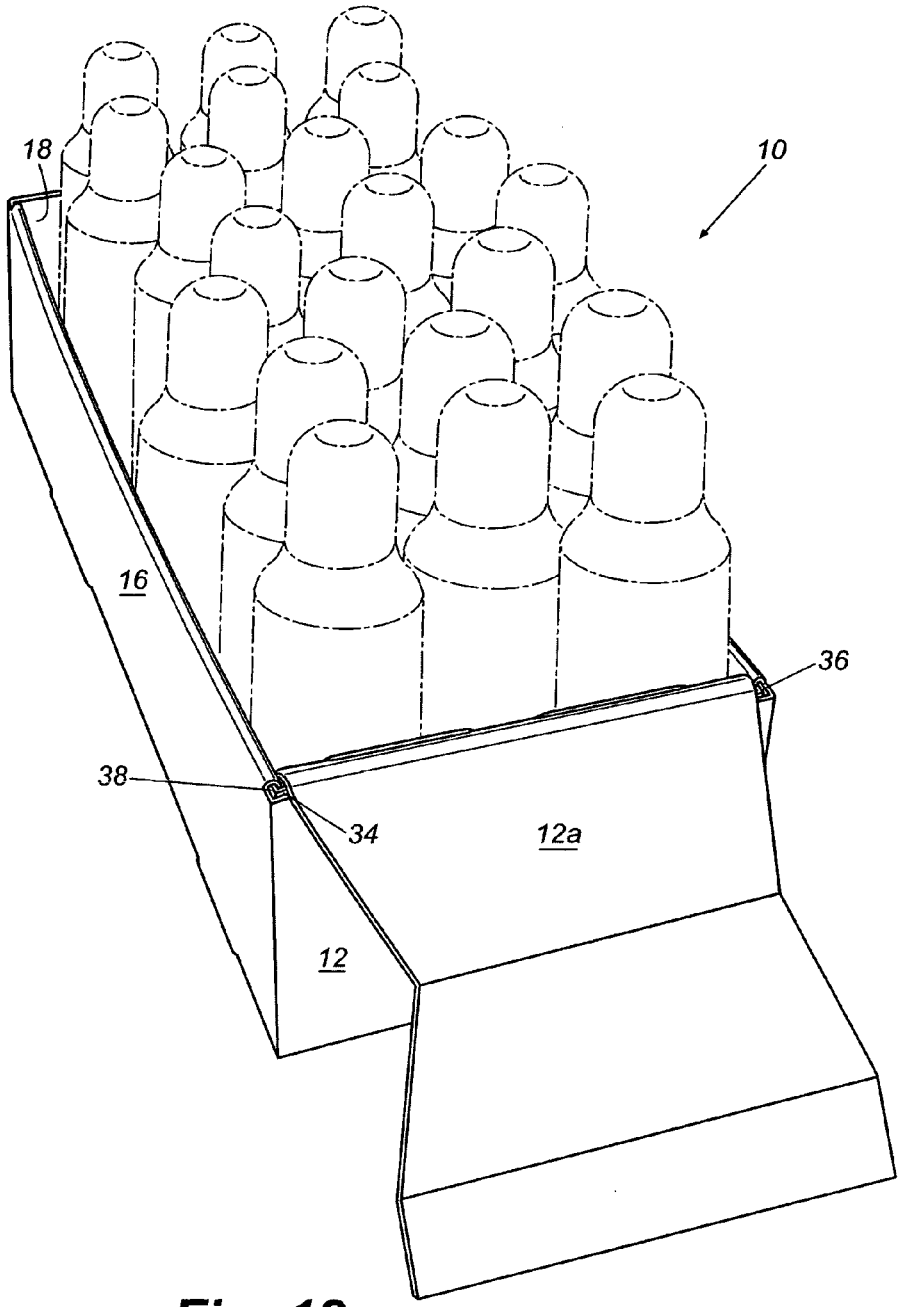
FIGS. 12-16 are perspective views of the display apparatus of FIG. 1 shown loaded with product.
Figure 13:
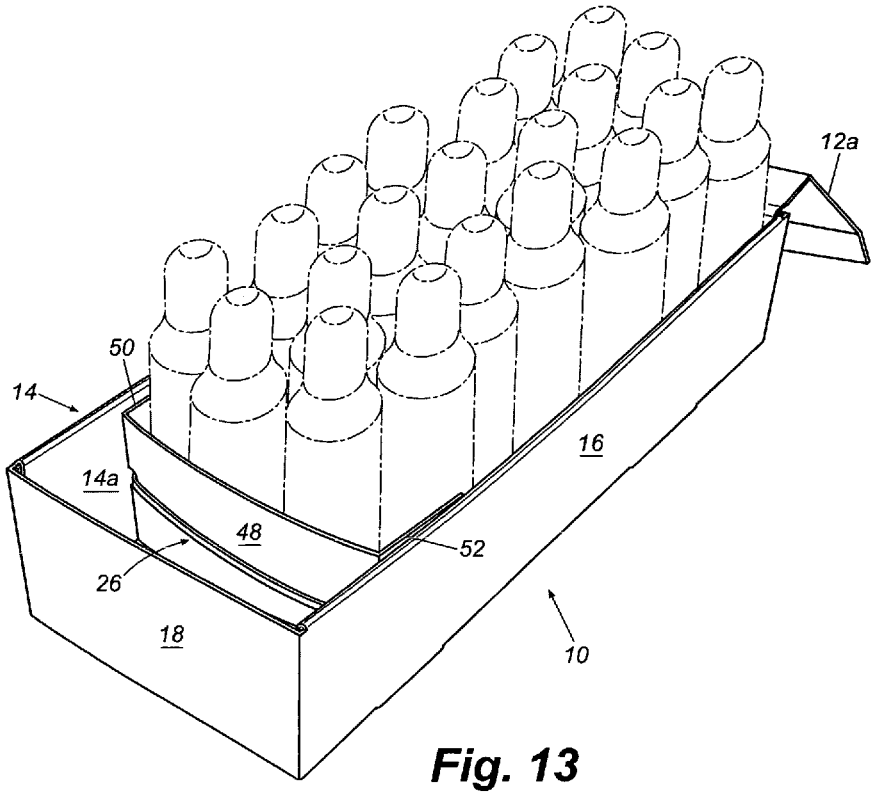
Figure 14:
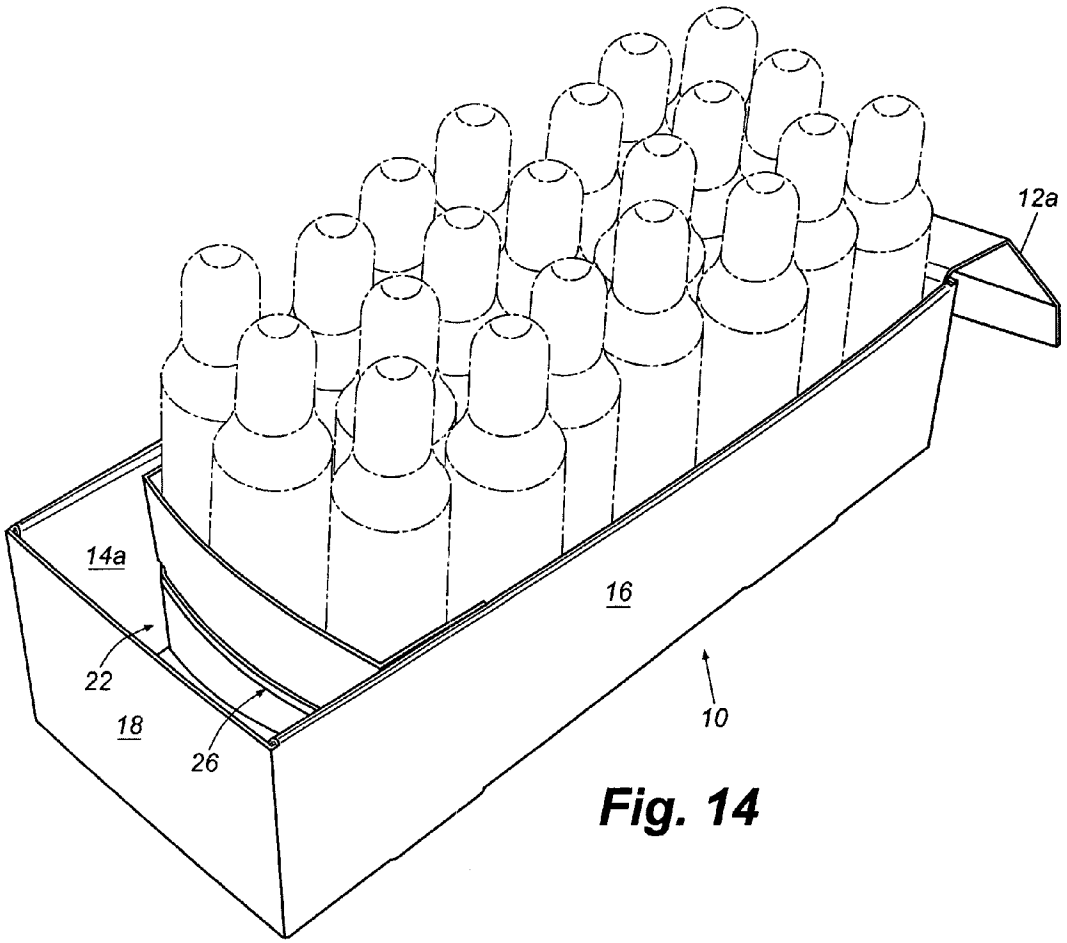
Figure 15:
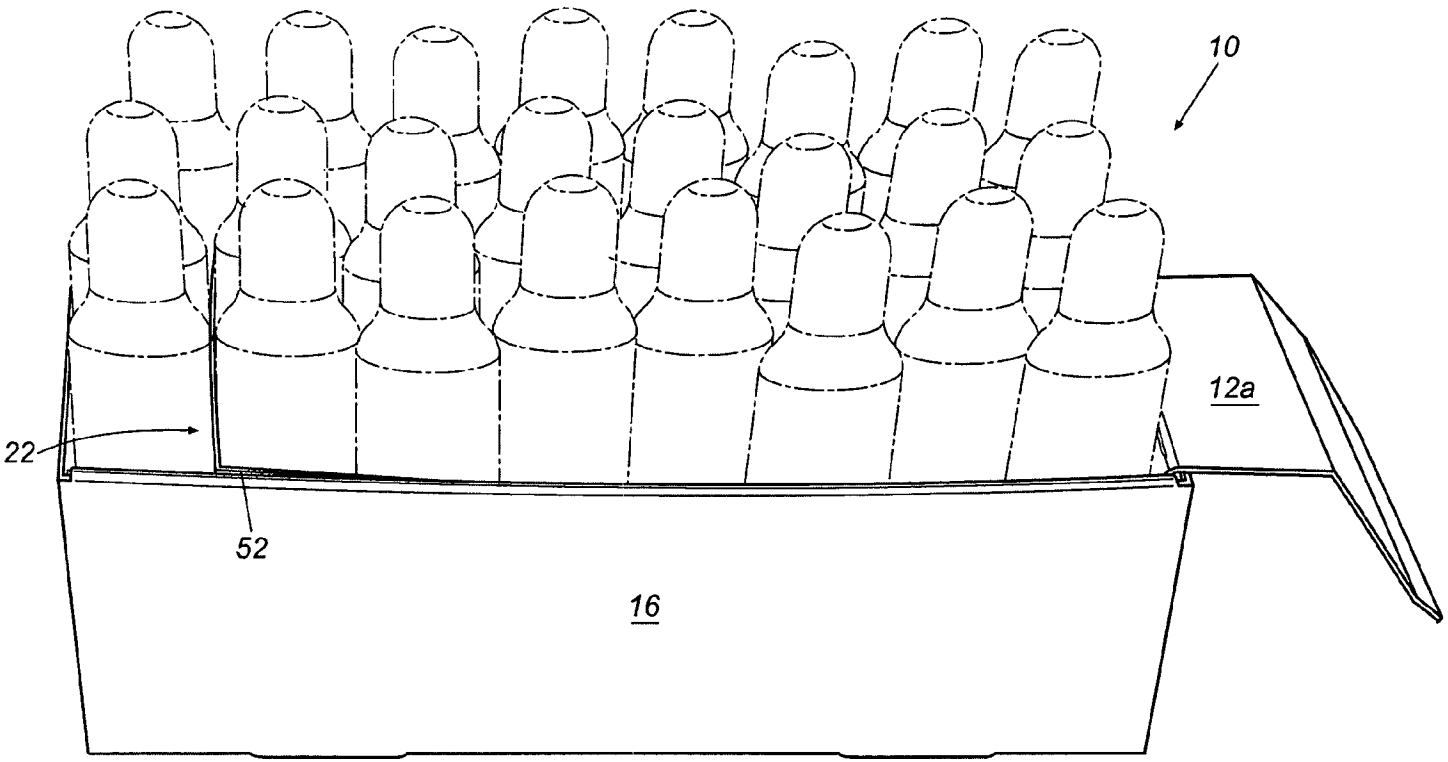
Figure 16:
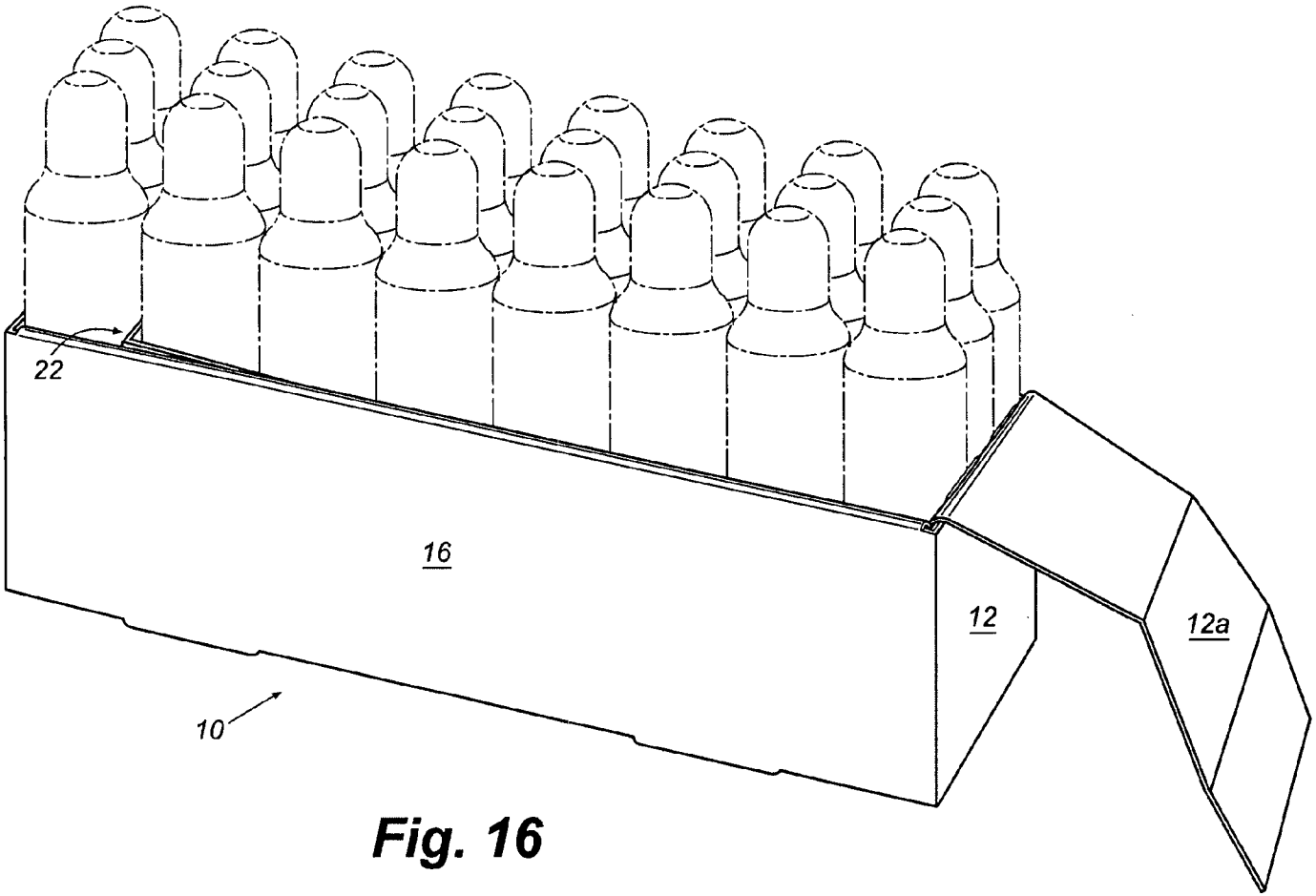
Figure 17:
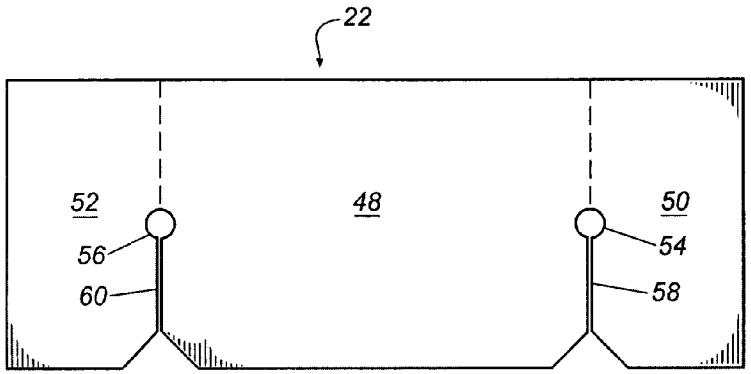
FIG. 17 is a plan view of the dispensing mechanism shown in FIG. 1.

Referring to FIG. 8, a first end 28 and a second end 30 of rubber band 26 is respectively connected to side walls 14 and 16 proximate front wall 12. It should be understood that other biasing mechanisms may be used, for example, elastic cord, bungee material, springs, etc. First and second ends 28 and 30 of rubber band 26 may be connected to side walls 14 and 16 by various methods, for example adhesive, slots formed in the walls or various other suitable attachment methods.

Figure 18:
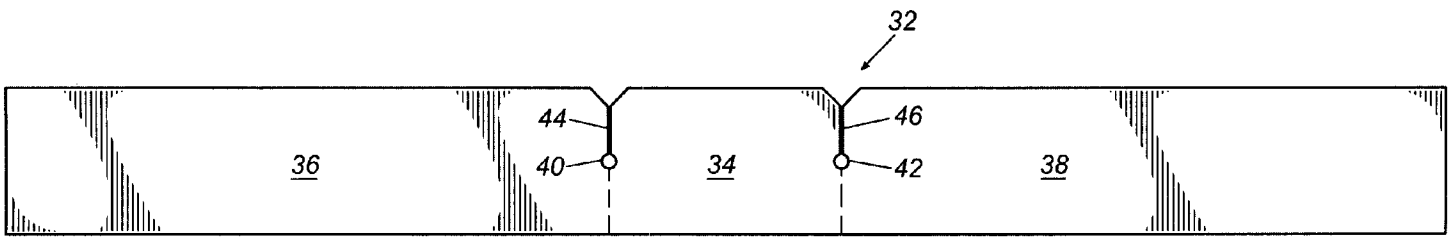
FIG. 18 is a plan view of a portion of the display apparatus shown in FIG. 1.

In one preferred embodiment, a U-shaped bracket 32 (FIGS. 6-7 and 18) is received proximate to front wall 12 and side walls 14 and 16. Bracket 32 is sized and shaped to fit snugly within display apparatus 10. Bracket 32 has a front wall 34, and two side walls 36 and 38. Front wall 34 is sized and shaped to substantially fit against display front wall 12, and side walls 36 and 38 are sized and shaped to substantially fit against respective display apparatus side walls 14 and 16. Two apertures 40 and 42 are formed at the corners where the bracket side walls attach to the front wall. Additionally two slits 44 and 46 are formed at the corners and intersect the apertures. The slits allow rubber band 26 to be seated about the front of front wall 34 so that a portion of the rubber band slides down through the slits and into apertures 40 and 42. That is, a portion of the rubber band (a first loop) is in front of front wall 34 and a portion (a second loop) is behind front wall 34 with the rubber band passing through apertures 40 and 42. U-shaped bracket 32 is placed inside display apparatus 10 so that front wall 34 is adjacent to display front wall 12 and bracket side walls 36 and 38 are adjacent respective display side walls 14 and 16. The portion (the second loop) of rubber band 26 that is behind bracket front wall 34 is received by slidable U-shaped wall 24.

Slidable U-shaped wall 22 has a front wall 48 and two side walls 50 and 52. Each side wall 50 and 52 connects to front wall 48 at a corner. Each corner contains an aperture 54 and 56 and a respective slit 58 and 60 intersects the aperture. The slits allow rubber band 26 to pass between the sidewalls and the front wall and into apertures 54 and 56 similar to that of U-shaped bracket 32. Thus, the portion of the rubber band behind U-shaped bracket front wall 34 slips behind slidable U-shaped wall front wall 48 and into apertures 54 and 56 through slits 58 and 60. Thus, the rubber band rests against the back surface of front wall 48.

In this configuration, as shown in particular in FIGS. 6-9 and 12-16, slidable U-shaped wall 22 can move toward display apparatus back wall 18 against the rubber band's forward bias so that product can be loaded between slidable wall 22 and display front wall 12. Consequently, as product is removed from the display apparatus, slidable wall 24 is biased forward toward display front wall 12 causing the remaining product to move forward toward the front of the display.

Figure 19:
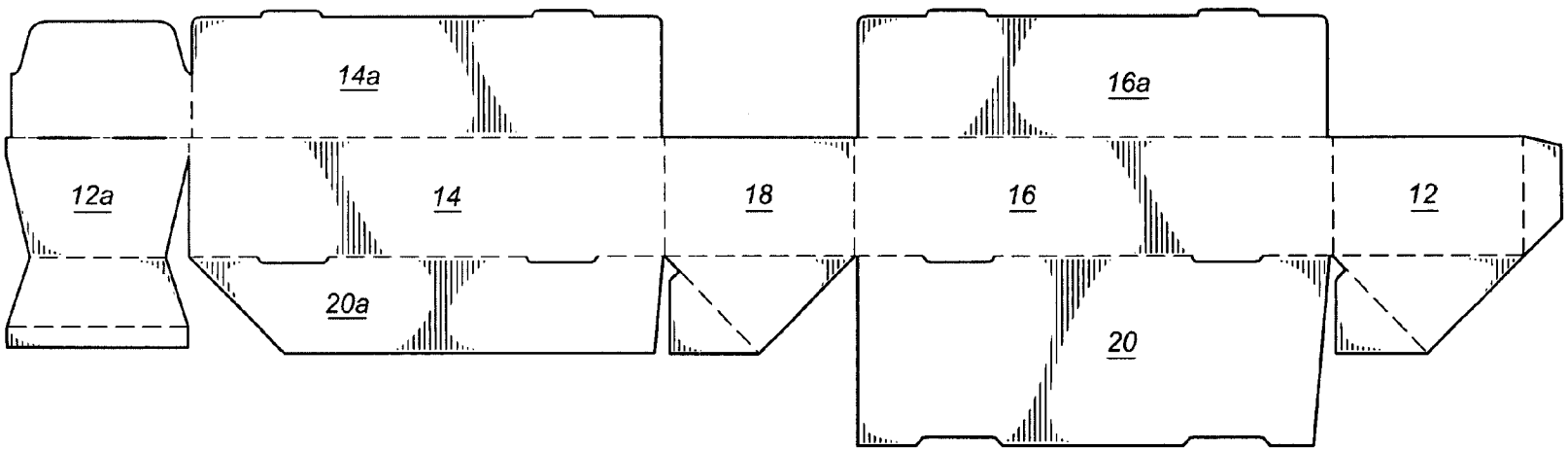
FIG. 19 is a plan view of a portion of the display apparatus shown in FIG. 1.

FIG. 19 illustrates one preferred embodiment of display apparatus 10 where the front, back, side and bottom walls are integrally formed. The walls are folded at respective corners to form display apparatus 10. Reinforcing members denoted by the letter "a" are folded against respective parts of the side walls so that U-shaped bracket 32 can be received in between front 12 and side walls 14 and 16 and their respective reinforcing members 12*a*, 14*a*, and 16*a*. Slots (not shown) formed in the reinforcing members allow rubber band 26 to pass from U-shaped bracket 32 to slidable U-shaped wall 22.

It should be understood that any of the parts of the display apparatus may be formed from polymers, card board or other suitable materials that can be bent into shape. Moreover, depending on the strength of the materials, the display apparatus can be reused over and over again.

What is claimed is:

1. A display apparatus for displaying and dispensing a plurality of items disposed therein, comprising:

a box having a front wall, a back wall, a first side wall, a second side wall, and a bottom wall, said box defining an interior volume;

a dispensing mechanism slidably disposed within said box along a longitudinal axis between said box front wall and said box back wall said dispensing mechanism including a first side wall extending parallel to said box first side wall, a second side wall extending parallel to said box second side wall, and a front wall extending therebetween, said dispensing mechanism front wall having a back surface facing said box back wall;

an elastic band having a first portion secured adjacent said box front wall and a second portion secured adjacent said dispensing mechanism front wall back surface; and a U-shaped bracket including a first side wall, a second side wall, and a front wall extending therebetween, said bracket front wall being adjacent said box front wall, said bracket first side wall being adjacent said box first side wall, said bracket second side wall being adjacent said box second side wall, and said first portion of said elastic band being disposed and secured between said box front wall and said bracket front wall, wherein said biasing device biases said dispensing mechanism toward said box front wall such that said dispensing mechanism is urged toward said box front wall as the items are removed from between said dispensing mechanism and said box front wall.

2. The display apparatus of claim 1, wherein said bracket first side wall, said bracket second side wall, and said bracket front wall are substantially similar in size to said box first side wall, said box second side wall, and said box front wall, respectively.

3. The display apparatus of claim 1, further comprising:

a first reinforcing member coupled to a top edge of said box first side wall; and a second reinforcing member coupled to a top edge of said box second side wall, wherein each of said first and said second reinforcing members is configured to be folded inwardly such that said bracket first side wall is disposed between said box first side wall and said first reinforcing member, and said bracket second side wall is disposed between said box second side wall and said second reinforcing member.

4. The display apparatus of claim 3, wherein said first and said second reinforcing members are substantially similar in size to said first and said second box side walls, respectively.

5. The display apparatus of claim 4, wherein:

each of said first and said second reinforcing members includes a first slot extending from an outer edge to a first aperture formed therein;

said dispensing mechanism includes a pair of second slots and a pair of second apertures, each said second slot extending from an outer edge of said dispensing mechanism to one of said second apertures;

said bracket includes a pair of third slots and a pair of third apertures, each said third slot extending from an outer edge of said bracket to one of said third apertures; and wherein each of said first, said second, and said third apertures is configured to receive and retain said elastic band therein.

6. The display apparatus of claim 4, further comprising a third reinforcing member configured to be folded inwardly such that said bracket front wall is disposed between said box front wall and said third reinforcing member.

7. A display apparatus for displaying a plurality of items, comprising:

a box having a front wall, a back wall, a bottom wall, a first side wall including a first reinforcing member coupled thereto, and a second side wall including a second reinforcing member coupled thereto;

a U-shaped bracket having a first side wall, a second side wall, and a front wall extending therebetween, said bracket being disposed in said box such that said bracket first side wall is disposed between said box first side wall and said first reinforcing member, said bracket second side wall is disposed between said box second side wall and said second reinforcing member, and said bracket front wall is adjacent said box front wall;

a dispensing mechanism slidably disposed within said box, said dispensing mechanism having a first side wall disposed adjacent said box first side wall, a second side wall disposed adjacent said box second side wall, and a front wall extending between said first and said second side walls of said dispensing mechanism; and a biasing device secured to said box and said dispensing mechanism such that said dispensing mechanism is biased toward said box front wall.

8. The display apparatus of claim 7, wherein said biasing device further comprises an elastic band having a first portion secured to said box and a second portion secured to said dispensing mechanism.

9. The display apparatus of claim 8, wherein said first portion of said elastic band is disposed and secured between said bracket front wall and said box front wall and said second portion of said elastic band is disposed adjacent a back surface of said dispensing mechanism front wall.

10. The display apparatus of claim 9, wherein said first side wall and said second side wall of said dispensing mechanism are disposed between said elastic band and said box first side wall and said box second side wall, respectively.

11. The display apparatus of claim 7, further comprising a third reinforcing member configured to be folded inwardly such that said bracket front wall is disposed between said box front wall and said third reinforcing member.

12. The display apparatus of claim 7, wherein each of said first and said second reinforcing members includes a first slot extending from an outer edge to a first aperture formed therein;

said dispensing mechanism includes a pair of second slots and a second pair of apertures, each said second slot extending from an outer edge of said dispensing mechanism to one of said second apertures;

said bracket includes a third pair of slots and a third pair of apertures, each said third slot extending from an outer edge of said bracket to one of said third apertures; and wherein each of said first, said second, and said third apertures is configured to receive and retain said elastic band therein.

13. A display apparatus for displaying and dispensing a plurality of items disposed therein, comprising:

a box having a front wall, a back wall, a first side wall, a second side wall, and a bottom wall, said box defining an interior volume;

a U-shaped wall including a front wall with a back surface, a first side wall extending from a first end of said front wall and a second side wall extending from a second end of said front wall, said U-shaped wall being slidably disposed within said box along a longitudinal axis between said box front wall and said box back wall;

a rubber band having a first portion secured adjacent said box front wall and a second portion secured adjacent said back surface of said front wall of said U-shaped wall, wherein said rubber band biases said U-shaped wall toward said box front wall such that said U-shaped wall is urged toward said box front wall as the items are removed from between said U-shaped wall and said box front wall.

14. The display apparatus of claim 13, wherein said U-shaped wall further comprises a first slit disposed between said first side wall and said front wall and a second slit disposed between said second side wall and said front wall, wherein said first and second slits are configured to slidably receive said rubber band therein.

15. A display apparatus for displaying and dispensing a plurality of items disposed therein, comprising:

a box having a front wall, a back wall, a first side wall, a second side wall, and a bottom wall, said box defining an interior volume; and an elastic band having a first portion connected to said first side wall, a second portion connected to said second side wall, a third portion secured adjacent said box front wall, and a fourth portion disposed within said interior volume of said box such that the items disposed within the box are also disposed within the elastic band, wherein said elastic band biases the items disposed within said elastic band toward said box front wall such that the items are urged toward said box front wall as each item is removed from said elastic band.

16. The display apparatus of claim 15, further comprising a first slot formed in said first side wall of said box and a second slot formed in said second side wall of said box, said first slot slidably receiving said first portion of said elastic band and said second slot slidably receiving said second portion of said elastic band.

17. The display apparatus of claim 15, further comprising a dispensing mechanism including a first side wall extending parallel to said box first side wall, a second side wall extending parallel to said box second side wall, and a front wall extending therebetween, said dispensing mechanism front wall having a back surface facing said box back wall, wherein said fourth portion of said elastic band rests against said dispensing mechanism front wall back surface.

* * * * *